US006485224B1

(12) United States Patent
Dyke et al.

(10) Patent No.: US 6,485,224 B1
(45) Date of Patent: Nov. 26, 2002

(54) TRAFFIC BARRIER APPARATUS WITH GATE

(75) Inventors: Gerrit Andrew Dyke, Stockton; Jack Sumner Mazer, Benicia, both of CA (US)

(73) Assignee: Barrier Systems, Inc., Rio Vista, CA (US)

( * ) Notice: Subject to any disclaimer, the term of this patent is extended or adjusted under 35 U.S.C. 154(b) by 0 days.

(21) Appl. No.: 09/759,003

(22) Filed: Jan. 11, 2001

(51) Int. Cl.[7] ..... E01F 13/00; E01F 15/00; E05D 11/00

(52) U.S. Cl. ..... 404/6; 256/13.1; 16/250

(58) Field of Search ..... 404/6; 256/13.1, 256/73; 49/49; 16/250

(56) References Cited

U.S. PATENT DOCUMENTS 4,658,543 A * 4/1987 Carr ..... 49/139
4,666,332 A * 5/1987 Burgett ..... 404/12
4,780,020 A * 10/1988 Terio ..... 404/6
4,806,044 A * 2/1989 Duckett ..... 16/361
4,815,889 A * 3/1989 Duckett ..... 256/13.1
5,009,542 A * 4/1991 Hardin, Jr. et al. ..... 404/6
5,136,810 A * 8/1992 DeWitt, III ..... 49/141
5,181,794 A * 1/1993 Wilson et al. ..... 404/6
5,551,796 A * 9/1996 Anderson et al. ..... 256/13.1
6,059,491 A * 5/2000 Striefel et al. ..... 256/13.1

* cited by examiner

*Primary Examiner*—Gary S. Hartmann
(74) *Attorney, Agent, or Firm*—Thomas R. Lampe

(57) ABSTRACT

A traffic barrier is pivotally attached to a gate by a hinge. A cover is releasably connected to the barrier and the gate and covers the hinge. When the cover is releasably connected to the barrier and the gate it will cooperate with the barrier and gate to resist relative movement between the barrier and gate at the hinge location.

17 Claims, 5 Drawing Sheets

TRAFFIC BARRIER APPARATUS WITH GATE

TECHNICAL FIELD

This invention relates to vehicular traffic barriers and more particularly to traffic barriers incorporating gates providing access through the barriers.

BACKGROUND OF THE INVENTION

Vehicular traffic barriers or dividers are in widespread usage. Some of these systems incorporate a plurality of concrete barrier modules disposed end to end.

It is known to provide gates in association with vehicular traffic barriers or dividers which will allow passage or access through barrier openings. It is very important that any such gate arrangement have sufficient strength to resist impact by a vehicle.. Otherwise, a vehicle hitting the gate could pass through to the other side of the barrier and create a dangerous situation. For example, vehicular traffic barriers or dividers are often employed to separate lanes of traffic or to provide protection for ongoing construction work. It will be appreciated that penetration of a vehicle through the barrier can have disastrous consequences. On the other hand, it is often important to provide access to the other side of a barrier by means of a gate for certain purposes.

DISCLOSURE OF INVENTION

The present invention relates to traffic barrier apparatus incorporating a barrier and gate. The barrier and gate are so constructed as to maintain high structural strength to resist relative movement between the gate and the barrier upon impact. Opening of the gate when desired however is a simple matter, the gate being opened from either end thereof as elected by the person handling such task.

The traffic barrier apparatus of the present invention includes a barrier having a barrier end and a gate having a gate end. A hinge pivotally interconnects the barrier end and the gate end.

A cover is releasably connected to the barrier and the gate and covers the hinge. The cover is cooperable with the barrier and the gate to resist relative movement between the barrier end and the gate end.

Other features, advantages and objects of the present invention will become apparent with reference to the following description and accompanying drawings.

BEST MODE FOR CARRYING OUT THE INVENTION

Figure 1:
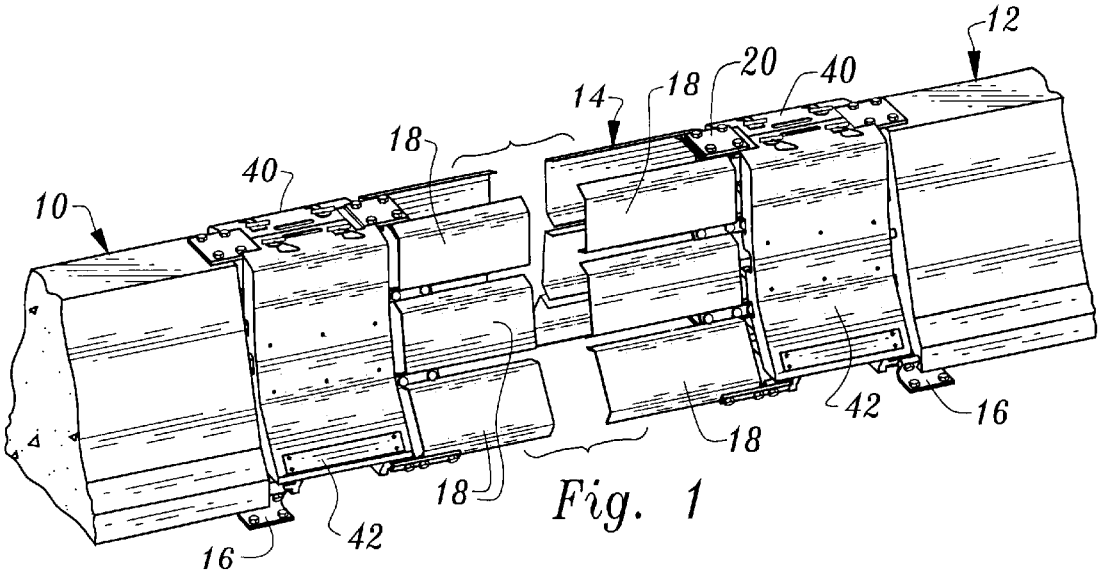
FIG. 1 is a perspective view illustrating two barriers having a gate therebetween and connected thereto in accordance with the teachings of the present invention.

Referring now to the drawings, two concrete barriers 10 and 12, respectively, are illustrated, the barriers defining a space between ends thereof within which is located a gate 14.

Barriers 10 and 12 are of standard construction, being formed of concrete. In the embodiment illustrated, brackets 16 are employed to secure the barriers to a roadway or other surface; however, it will be understood that the principles of the present invention apply to any vehicular traffic barrier systems, including those in which the barriers are not positively secured in place.

The gate 14 is formed of channel members 18 secured together by any known expedient such as brackets 20, 22. The precise construction of the gate 14 is not important to the present invention, although it should be noted that the outer configuration of the gate is generally the same as the outer configurations of barriers 10 and 12.

Referring to FIGS. 3–6, 8 and 9, hinges 24, 26 are disposed at opposed ends of the gate.

Each hinge includes a hinge member 28 affixed to a barrier end and a hinge member 30 affixed to a gate end. Each hinge member in turn includes a face plate 34 and lugs 36 projecting from the face plate. Any suitable means, such as the illustrated mechanical fasteners, may be employed to secure the face plates 34 to the ends of the barriers and gate. In the arrangement shown, the face plates are spaced somewhat from the ends of the barriers and gate.

Figure 5:
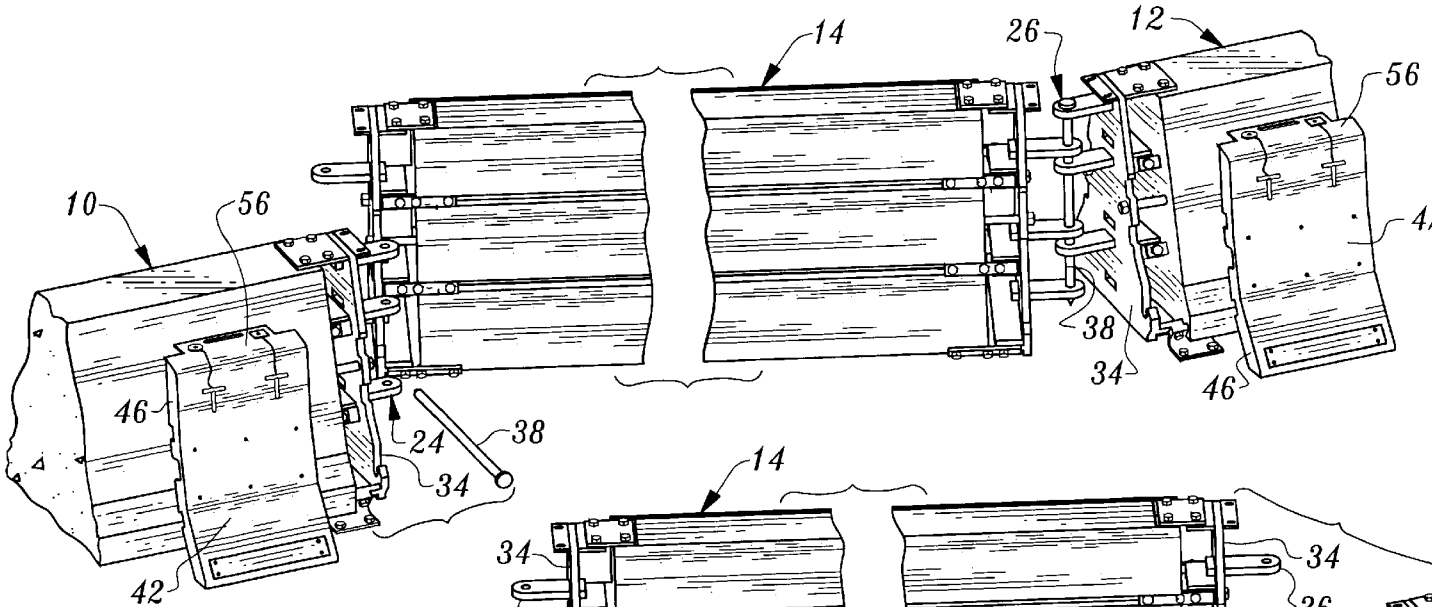
FIG. 5 is a perspective view illustrating one end of the gate swung away about the hinge located at the other end of the gate.
Figure 6:
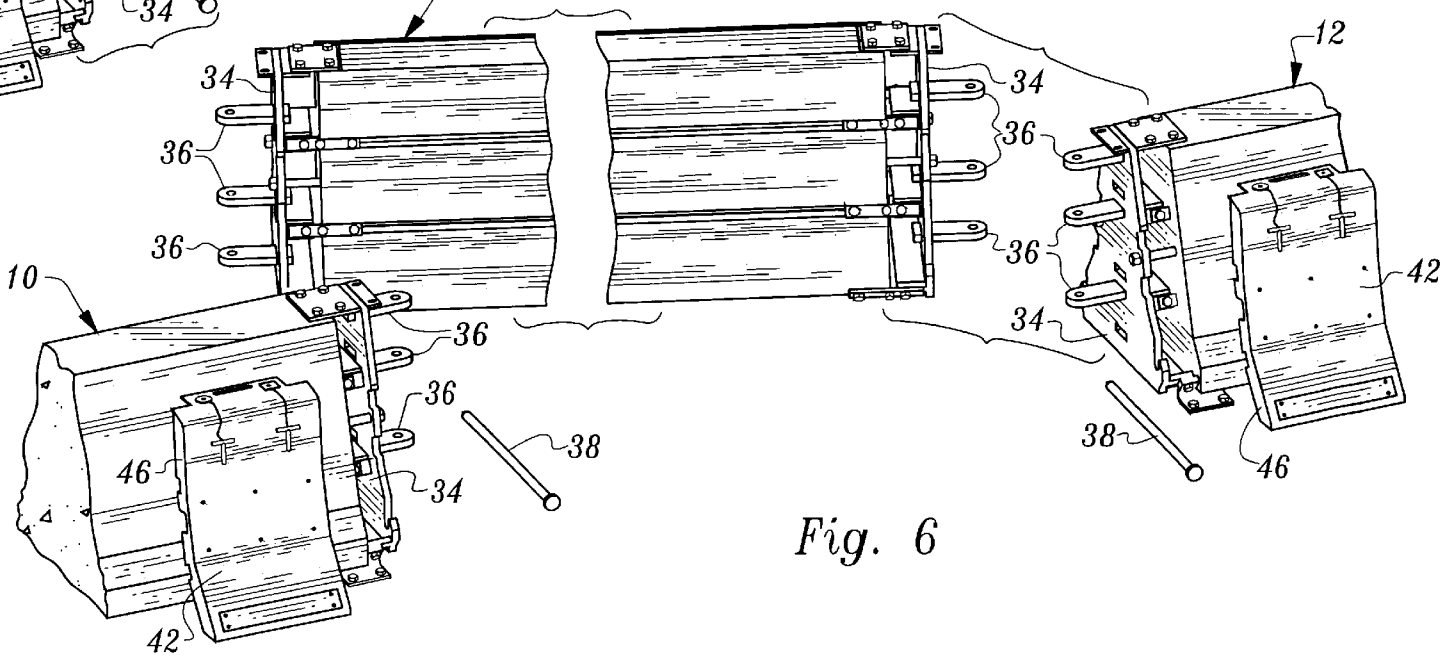
FIG. 6 shows the gate completely separated from both of the barriers.

The lugs 36 have aligned apertures which receive a master or pivot pin 38. Pivot pin 38 is selectively removable from the lugs merely by pulling upwardly thereon to disconnect -,the lugs and allow the gate to be swung away from the barrier end as shown in FIG. 5. FIG. 6 shows the pin having been pulled from both ends of the gate so that it can be completely removed from the barriers. The pivot pin 38 when in place in the lugs 36 will allow pivotal movement between the gate and a barrier if the hinge at the other end of the gate has the pin removed.

Figure 2:
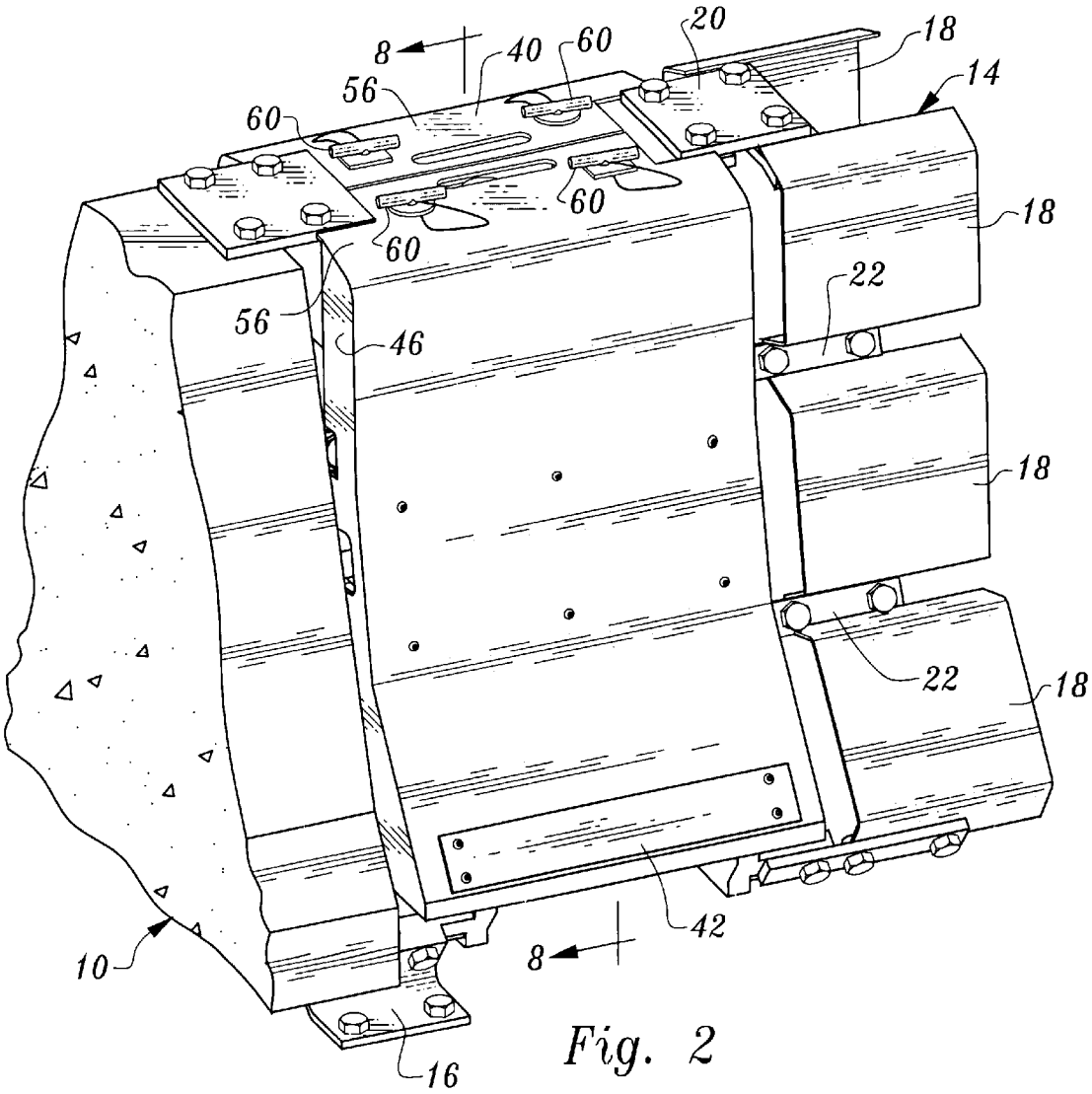
FIG. 2 is an enlarged, perspective view showing an end of a barrier, an end of the gate and a preferred embodiment of the apparatus of the present invention disposed therebetween and interconnecting the barrier and gate.
Figure 3:
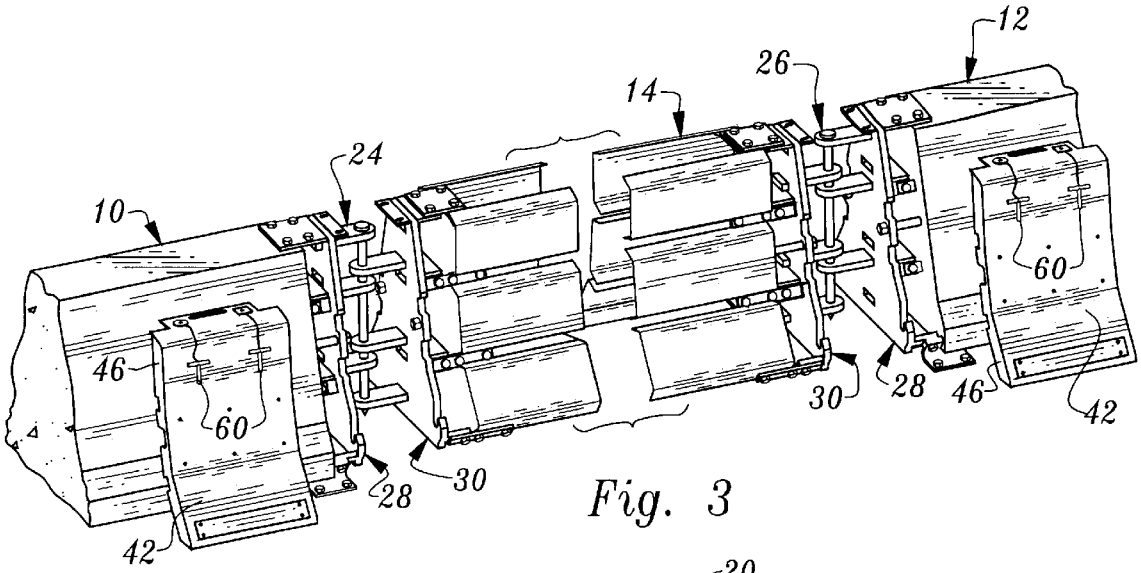
FIG. 3 is a view similar to FIG. 1 but illustrating details of the hinges and related structure employed in the invention, covers normally associated therewith having been removed.
Figure 4:
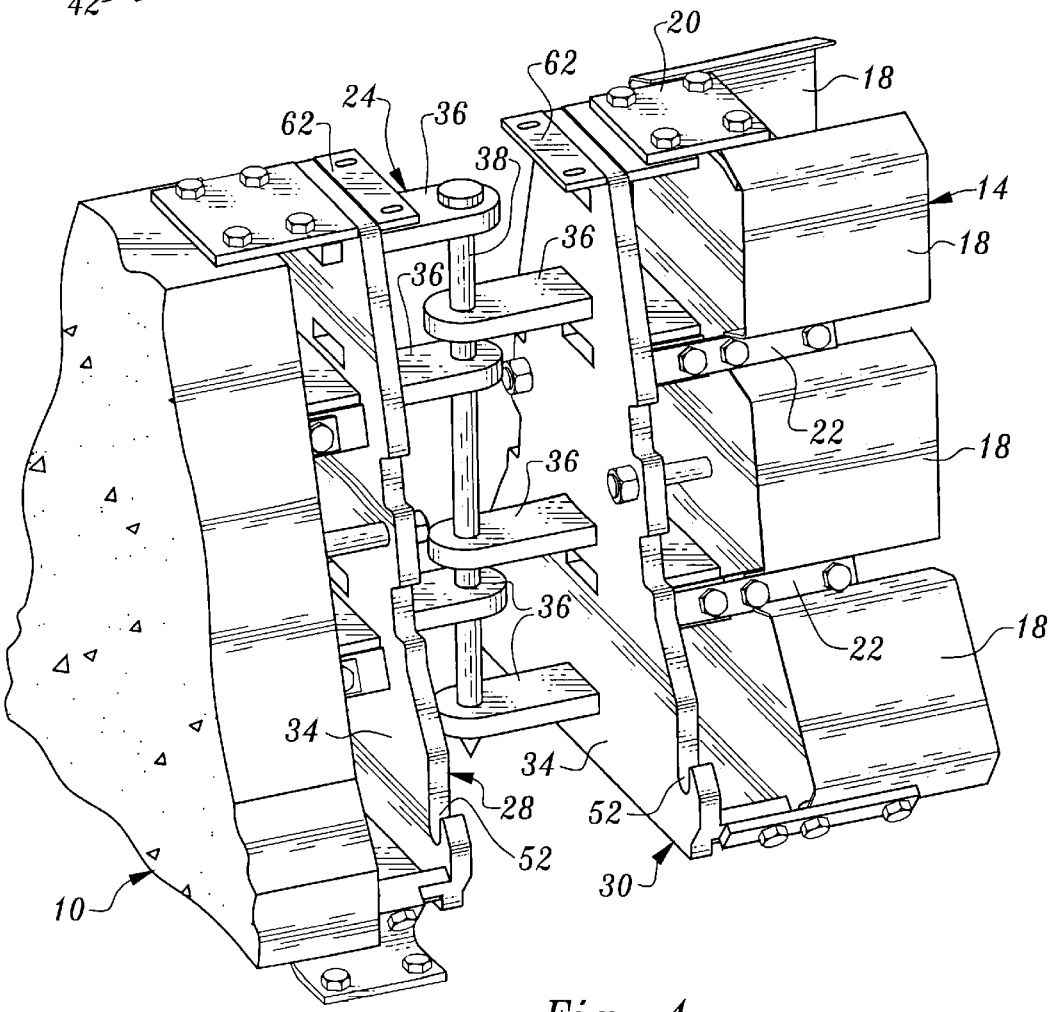
FIG. 4 is a view similar to FIG. 2 but illustrating details of hinge structure.
Figure 8:
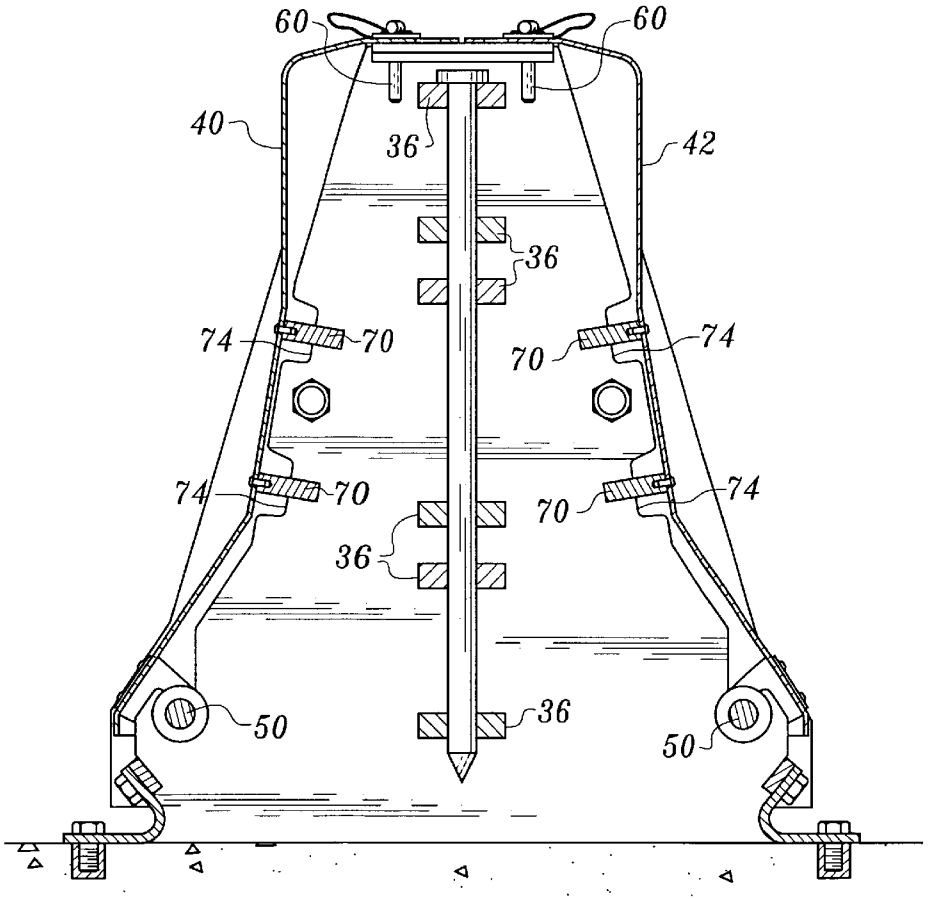
FIG. 8 is an enlarged, cross-sectional view taken along line 8—8 in FIG. 2.
Figure 7:
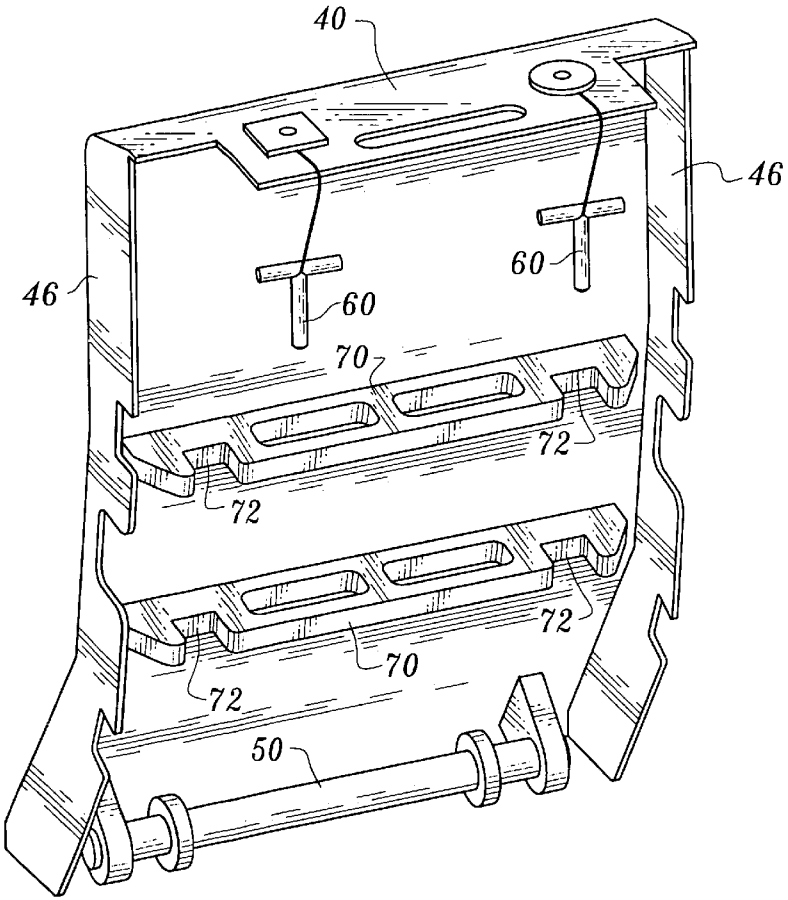
FIG. 7 is a rear, perspective view of a cover segment employed in the apparatus.
Figure 9:
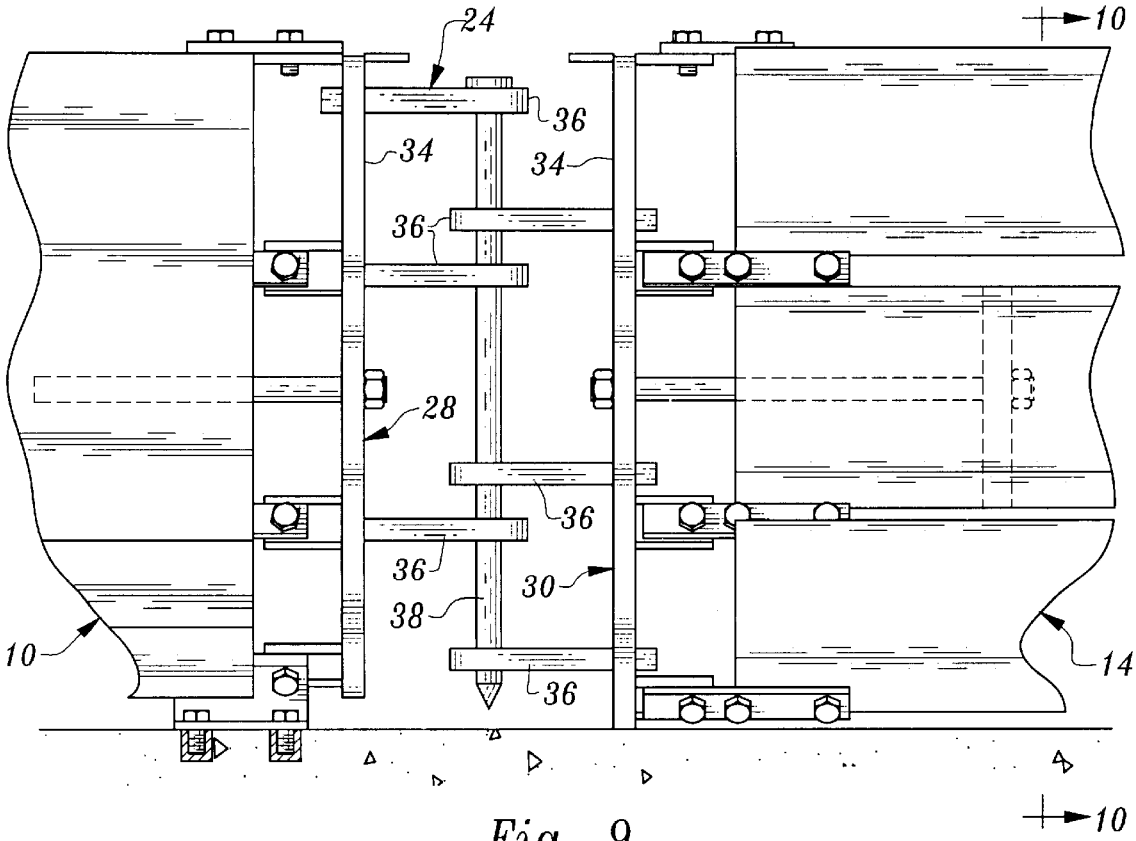
FIG. 9 is a front elevational view of a barrier end, a gate end and hinge structure disposed therebetween and interconnecting the barrier and gate.

Covers are provided at both ends of the gate when the gate is secured at both ends to the barriers by the pivot pins. Each cover includes a cover segment 40 and a cover segment 42, these cover segments being disposed on opposite sides of the hinge when the gate is fully secured to the barriers. This situation is shown in FIGS. 1, 2 and 8. The covers protect the hinges from vehicle intrusion and snagging while reinforcing the structural integrity of the hinge. Each cover is formed to generally match the contours of the barrier and gate profiles, providing an "anti-snagging" feature. It will be noted that the cover segments include inwardly projecting end flanges 46 which eliminate any grappling edges.

A connector bar 50 extends across each cover segment at the inside bottom thereof. When applying the cover segments over the hinges, bars 50 are positioned in aligned recesses or notches 52 defined by face plates 34 near the bottoms thereof on both sides of the face plates. The cover segments are then swung into the position shown in FIGS. 1, 2 and 8 with the cover segment tops 56 thereof disposed over the hinges. Securement pins 60 are then inserted through the cover segment tops and through openings formed in brackets 62 (see FIG. 4) extending from face plates 34. The connector bars 50 and securement pins provide a positive means for releasably securing the cover segments to the barriers and gate. The tops 56 are preferably reinforced where the pins 60 are inserted. Also, reinforcement should exist where the connector bars 50 are attached to the cover segments. Reinforcement at these critical locations virtually ensures that the cover segments will not be torn from the hinge.

Each cover segment has rails 70 secured thereto and extending inwardly. The rails 70 have notches 72 formed therein which receive the outer edges of the face plates in the area of notches 74 formed-in the face plates.

Along with connector bar 50, rails 70 serve not only to lock the hinging mechanism but also act as positioning guides for installation of the cover segments. In case of a vehicle impact, the notched rails and connector bar 50 interlock with the face plates and counter the moment created by gate deflection. The face plates distribute the load between the pivot pins 38 and the cover segments. Each pivot pin 38 secures the link between the associated barrier and gate while the longitudinal panels or members of the cover segments restrict the rotation of the hinge. By maintaining the opposing face plates together as a unit, the rotational force is transmitted in tension and compression through the cross section of the longitudinal panels of the cover segments.

To open gate 14, the cover members at each end of the gate must first be removed. The cover members can be stored inside the gate. The pivot pin 38 is then removed from the side of the gate to be opened. The gate can now pivot about the pivot pin on the opposite end of the gate. To close the gate the opening procedure is reversed.

Figure 10:
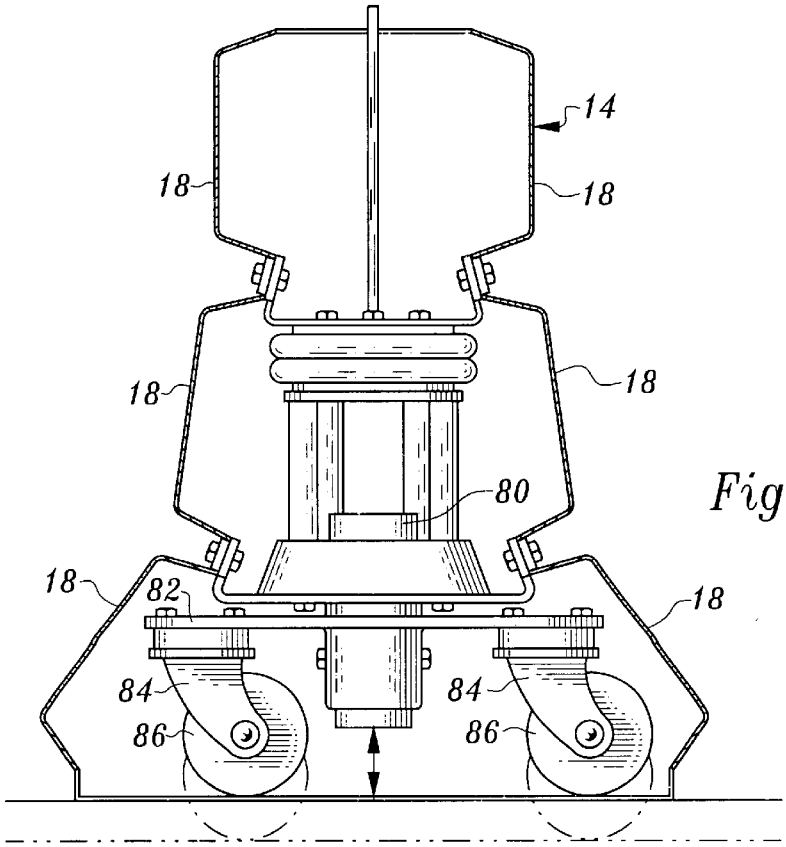
FIG. 10 is a cross-sectional view taken along the line 10—10 in FIG. 9.

FIG. 10 illustrates an arrangement for facilitating movement of gate 14. In this arrangement, a pneumatic or hydraulic cylinder 80 is connected to a platform 82 from which wheel supports 84 and wheels 86 project. By actuating the cylinder 80, the wheels can be moved between a retracted position (shown in solid lines in FIG. 10) and an extended position shown in phantom lines. In the latter position, the wheels engage the roadway or other support surface and make it easier to swing the gate. Other means such as air cushions could be employed to facilitate gate movement. And, of course, the teachings of the present invention are applicable to barriers with gates with no wheels, air cushions or other gate movement facilitating means.

The invention claimed is:

1. Traffic barrier apparatus comprising, in combination:

a barrier having a barrier end;

a gate having a gate end;

a hinge pivotally interconnecting said barrier end and said gate end; and a substantially rigid cover releasably, substantially rigidly interconnecting said barrier end and said gate end, said cover covering said hinge and cooperable with said barrier and said gate to lock said barrier and said gate against relative pivotal movement about said hinge when said traffic barrier apparatus is impacted by a vehicle.

2. The traffic barrier apparatus according to claim 1 wherein said hinge includes a first hinge member affixed to said barrier end and a second hinge member affixed to said gate end and a pivot pin interconnecting said first hinge member and said second hinge member.

3. The traffic barrier apparatus according to claim 2 wherein said cover includes a first cover segment and a second cover segment, said first and second cover segments being disposed on opposite sides of said hinge and releasably connected by cover connector means to said first hinge member and said second hinge member.

4. The traffic barrier apparatus according to claim 3 wherein said first and second cover segments each include a cover segment top and cover segment bottom, said cover connector means including cover segment mounting members located at said cover segment bottoms, said first hinge member and said second hinge member defining recesses accommodating said cover segment mounting members to releasably connect the cover segment bottoms to said first hinge member and said second hinge member.

5. The traffic barrier apparatus according to claim 4 wherein said cover segment mounting members comprise bars extending lengthwise along said cover segment bottoms, said recesses being in substantial alignment and receiving said bars.

6. The traffic barrier apparatus according to claim 4 wherein said cover connector means includes mechanical fasteners releasably connecting said cover segment tops to said first and second hinge members.

7. The traffic barrier apparatus according to claim 6 wherein said mechanical fasteners comprise securement pins extending between and interconnecting said cover segment tops and said first and second hinge members.

8. The traffic barrier apparatus according to claim 2 wherein said first and second hinge members include face plates and lugs defining apertures affixed to said face plates and extending therefrom, said pivot pin being releasably positioned in aligned apertures defined by said lugs.

9. The traffic barrier apparatus according to claim 3 wherein said first and second cover segments and said first and second hinge members include interlocking notches and protrusions for facilitating installation of the first and second cover segments on the first and second hinge members and for imparting strength to the traffic barrier apparatus.

10. The traffic barrier apparatus according to claim 9 wherein said protrusions include rails formed on said first and second cover segments and wherein said notches are formed in said first and second hinge members and receive said rails.

11. The traffic barrier apparatus according to claim 10 wherein said rails define notches receiving said first and second hinge members at the location of the notches formed in said first and second hinge members.

12. The traffic barrier apparatus according to claim 11 wherein said first and second hinge members include face plates, the notches formed in said first and second cover members being in said face plates.

13. The traffic barrier apparatus according to claim 3 wherein said first and second cover segments include inwardly projecting end flanges.

14. The traffic barrier apparatus according to claim 1 wherein said barrier, said gate and said cover have generally identical outer contours.

15. Traffic barrier apparatus comprising, in combination:

a first barrier having a first barrier end;

a second barrier having a second barrier end, said first and second barriers positioned on a surface with said first barrier end located a distance from said second barrier end to define a space between said first barrier and said second barrier;

a gate having first and second gate ends disposed between said first barrier and said second barrier within said space;

a first hinge located between and pivotally interconnecting said first gate end with said first barrier end;

a second hinge located between and pivotally interconnecting said second gate end with said second barrier end;

a first substantially rigid cover releasably, substantially rigidly interconnecting said first barrier end and said first gate end, said first cover covering said first hinge and cooperable with said first barrier and said gate to lock said first barrier and said gate against relative pivotal movement about said first hinge when said traffic barrier apparatus is impacted by a vehicle; and a second substantially rigid cover releasably, substantially rigidly interconnecting said second barrier end and said second gate end, said second cover covering said second hinge and cooperable with said second barrier and said gate to lock said second barrier and said gate against relative pivotal movement about said second hinge when said traffic barrier apparatus is impacted by a vehicle.

16. The traffic barrier apparatus according to claim 15 wherein each of said first and second hinges includes a first hinge member affixed to one of said barriers, a second hinge member affixed to said gate and a selectively removable pivot pin interconnecting the first hinge member and the second hinge member whereby said gate may be selectively disconnected from a barrier at either end of said gate.

17. Traffic barrier apparatus comprising, in combination:

a barrier having a barrier end;

a gate having a gate end;

a hinge pivotally interconnecting said barrier end and said gate end; and a cover releasably connected to said barrier and said gate covering said hinge and cooperable with said barrier and said gate to resist relative pivotal movement between said barrier end and said gate end, said hinge including a first hinge member affixed to said barrier end and a second hinge member affixed to said gate end and a pivot pin interconnecting said first hinge member and said second hinge member, said cover including a first cover segment and a second cover segment, said first and second cover segments being disposed on opposite sides of said hinge and releasably connected by cover connector means to said first hinge member and said second hinge member, said first and second cover segments each including a cover segment top and cover segment bottom, said cover connector means including cover segment mounting members located at said cover segment bottoms, said first hinge member and said second hinge member defining recesses accommodating said cover segment mounting members to releasably connect the cover segment bottoms to said first hinge member and said second hinge member, and said cover segment mounting members comprising bars extending lengthwise along said cover segment bottoms, with said recesses being in substantial alignment and receiving said bars.

* * * * *